US010535285B2

(12) United States Patent
Zeng

(10) Patent No.: US 10,535,285 B2
(45) Date of Patent: Jan. 14, 2020

(54) GOA DISPLAY PANEL AND GOA DISPLAY APPARATUS

(71) Applicant: Shenzhen China Star Optoelectronics Semiconductor Display Technology Co., Ltd., Shenzhen, Guangdong (CN)

(72) Inventor: Mian Zeng, Guangdong (CN)

(73) Assignee: Shenzhen China Star Opto Semicon Display Tech Co., Shenzhen, Guangdong (CN)

( * ) Notice: Subject to any disclaimer, the term of this patent is extended or adjusted under 35 U.S.C. 154(b) by 208 days.

(21) Appl. No.: 15/574,711

(22) PCT Filed: Aug. 29, 2017

(86) PCT No.: PCT/CN2017/099405
§ 371 (c)(1),
(2) Date: Nov. 16, 2017

(87) PCT Pub. No.: WO2019/015022
PCT Pub. Date: Jan. 24, 2019

(65) Prior Publication Data

US 2019/0027074 A1 Jan. 24, 2019

(30) Foreign Application Priority Data

Jul. 19, 2017 (CN) ..... 2017 1 0592922

(51) Int. Cl.
*G09G 3/00* (2006.01)
*G09G 3/36* (2006.01)

(52) U.S. Cl.
CPC ..... *G09G 3/006* (2013.01); *G09G 3/3677* (2013.01); *G09G 2310/0216* (2013.01); *G09G 2310/06* (2013.01); *G09G 2310/08* (2013.01)

(58) Field of Classification Search
None
See application file for complete search history.

(56) References Cited

U.S. PATENT DOCUMENTS

2007/0109011 A1* 5/2007 Jun ..... G09G 3/006 324/760.02
2008/0136964 A1* 6/2008 Yamazaki ..... G09G 3/3648 348/450
2008/0143759 A1* 6/2008 Chien ..... G09G 3/3674 345/698
2010/0039361 A1* 2/2010 Hsu ..... G09G 3/3677 345/92
2010/0097366 A1* 4/2010 Kitayama ..... G09G 3/3614 345/213

(Continued)

*Primary Examiner* — Kent W Chang
*Assistant Examiner* — Nathaniel P Brittingham
(74) *Attorney, Agent, or Firm* — Frank Gao

(57) ABSTRACT

A gate driver on array (GOA) display panel and a GOA display apparatus are disclosed. The display panel has a scan driving circuit, a data driving circuit, a thin-film transistor array, a plurality of scanning lines, a plurality of data lines, and a sub-pixel array. Starting from the first row of the sub-pixels, two of the scanning lines that are connected to two adjacent odd-numbered rows of the sub-pixels are both connected to a first clock signal control terminal; two of the scanning lines that are connected to two adjacent even-numbered rows of the sub-pixels are both connected to a second clock signal control terminal.

7 Claims, 2 Drawing Sheets

(56) References Cited

U.S. PATENT DOCUMENTS

| | | | | |
|---|---|---|---|---|
| 2013/0241812 | A1* | 9/2013 | Fujikawa | G09G 5/003 345/84 |
| 2013/0271357 | A1* | 10/2013 | Wang | G09G 3/3677 345/92 |
| 2015/0185520 | A1* | 7/2015 | Xu | G02F 1/13306 349/38 |
| 2015/0340003 | A1* | 11/2015 | Choi | G09G 3/3696 345/92 |
| 2016/0182042 | A1* | 6/2016 | Kim | G09G 3/3225 345/213 |
| 2016/0329354 | A1* | 11/2016 | Li | G02F 1/1335 |
| 2017/0270882 | A1* | 9/2017 | Mori | G06F 3/0412 |
| 2018/0025691 | A1* | 1/2018 | Ota | G09G 3/36 345/96 |
| 2018/0158396 | A1* | 6/2018 | Lee | G02B 27/017 |
| 2018/0203273 | A1* | 7/2018 | Zeng | G02F 1/1343 |
| 2018/0240432 | A1* | 8/2018 | Zhao | G09G 3/3677 |
| 2019/0027074 | A1* | 1/2019 | Zeng | G09G 3/006 |

* cited by examiner

GOA DISPLAY PANEL AND GOA DISPLAY APPARATUS

FIELD OF THE INVENTION

The present disclosure relates to the technical field of displays, and more particularly to a GOA display panel and a GOA display apparatus.

DESCRIPTION OF THE RELATED ART

GOA, which refers to Gate Driver on Array, uses an array manufacturing process of a thin-film transistor liquid crystal display apparatus to make a gate driving circuit on a thin-film transistor array substrate for line-by-line scanning. The technique has advantages of reducing production cost and allows for slim bezel design, making it suitable for liquid crystal displays.

In testing a panel, signals are sent to light the panel through a pixel testing panel, which is different from direct-lit module which sends signals to light the panel through a printed circuit board. By sending signals to light the panel through a pixel testing panel, driving strength of given signals is obviously not as strong as that of signals provided through the printed circuit board, and connection wires for connecting the pixel testing panel are relatively longer and have a relatively larger resistance which leads to faster signal attenuation. Therefore, in general, the data signals provided for panel unit testing are all positive frame direct-current signals or down-converted signals so that the signals are not heavily distorted when arriving pixels of the panel and are able to light the display screen for panel testing.

In a typical pixel conversion structure design, when performing panel unit testing, if each of a red pixel unit, a blue pixel unit, and a green pixel unit is directly given a positive-frame DC signal, the screen will display an image with mixed-colors including red plus blue, red plus green, and blue plus green. However, it is difficult to utilize the image with mixed-colors to detect bright and dark lines, photoresist defects, or uneven red, green, or blue images. In a non-GOA type product, by connecting odd-numbered rows and connecting even-numbered rows through gate electrodes, and driving gate electrodes in the odd-numbered rows to correspondingly provide a positive-frame low-frequency signal to red pixel units and then driving gate electrodes in the even-numbered rows to correspondingly provide a positive-frame low-frequency signal to green pixel units, and a pure red image can be displayed on the screen for detecting defects. However, in a GOA product, where scanning signals are output to each row of gate electrodes on a GOA circuit by units, the GOA circuit is unable to have the gate electrodes connected based on odd-numbered rows or even-numbered rows like a non-GOA type product if the GOA circuit is still provided with a normal GOA clock signal. Thus, it is difficult to display a pure colored image of red, green, or blue to perform panel testing.

In conclusion, in conventional technology, when a GOA display panel goes through a panel unit testing by using a module to light a pure colored image through a printed circuit broad, an image with mixed-colors including red plus blue, red plus green, and blue plus green will be displayed instead, thereby being unable to accurately detect screen defects.

SUMMARY OF THE INVENTION

The present disclosure provides a GOA display panel and a GOA display apparatus which can be tested by displaying a pure color image of red, green, or blue on a screen, thereby enhancing defect detection rate.

The present disclosure provides a GOA display panel having: a scan driving circuit, a data driving circuit, a thin-film transistor array, a plurality of scanning lines, a plurality of data lines, and a sub-pixel array, wherein the sub-pixel array includes a plurality of first sub-pixels, a plurality of second sub-pixels, and a plurality of third sub-pixels; the first sub-pixels are red sub-pixels; the second sub-pixels are green sub-pixels; and the third sub-pixels are blue sub-pixels;

wherein each of the scanning lines is connected to a row of sub-pixels; wherein starting from the first row of the sub-pixels, two of the scanning lines that are connected to two adjacent odd-numbered rows of the sub-pixels are both connected to a first clock signal control tell final; two of the scanning lines that are connected to two adjacent even-numbered rows of the sub-pixels are both connected to a second clock signal control terminal;

wherein the GOA display panel further comprises a plurality of the first clock signal control terminals and a plurality of the second clock signal control terminals having the same number as the first clock signal control terminals; the adjacent first clock signal control terminals and second clock signal control terminals successively turn on the corresponding scanning lines.

According to a preferred embodiment of the present disclosure, the GOA display panel comprises two of the first clock signal control terminals.

According to a preferred embodiment of the present disclosure, the first clock signal control terminals and the second clock signal control terminals successively and alternately enable the corresponding scanning lines.

According to a preferred embodiment of the present disclosure, the first clock signal control terminals and the second clock signal control terminals have an overlapped enabling time.

The present disclosure further provides another GOA display panel having: a scan driving circuit, a data driving circuit, a thin-film transistor array, a plurality of scanning lines, a plurality of data lines, and a sub-pixel array, the sub-pixel array includes at least two sub-pixels;

wherein each of the scanning lines is connected to a row of sub-pixels; wherein starting from the first row of the sub-pixels, two of the scanning lines that are connected to two adjacent odd-numbered rows of the sub-pixels are both connected to a first clock signal control terminal; two of the scanning lines that are connected to two adjacent even-numbered rows of the sub-pixels are both connected to a second clock signal control terminal;

wherein the GOA display panel further comprises a plurality of the first clock signal control terminals and a plurality of the second clock signal control terminals having the same number as the first clock signal control terminals; the adjacent first clock signal control terminals and second clock signal control terminals successively turn on the corresponding scanning lines.

According to a preferred embodiment of the present disclosure, the GOA display panel comprises two of the first clock signal control terminals.

According to a preferred embodiment of the present disclosure, the first clock signal control terminals and the second clock signal control terminals successively and alternately enable the corresponding scanning lines.

According to a preferred embodiment of the present disclosure, the first clock signal control terminals and the second clock signal control terminals have an overlapped enabling time.

The present disclosure further provides a GOA display apparatus having: a scan driving circuit, a data driving circuit, a thin-film transistor array, a plurality of scanning lines, a plurality of data lines, and a sub-pixel array, the sub-pixel array includes at least two sub-pixels;

wherein each of the scanning lines is connected to a row of sub-pixels; wherein starting from the first row of the sub-pixels, two of the scanning lines that are connected to two adjacent odd-numbered rows of the sub-pixels are both connected to a first clock signal control terminal; two of the scanning lines that are connected to two adjacent even-numbered rows of the sub-pixels are both connected to a second clock signal control terminal;

wherein the GOA display panel further comprises a plurality of the first clock signal control terminals and a plurality of the second clock signal control terminals having the same number as the first clock signal control terminals; the adjacent first clock signal control terminals and second clock signal control terminals successively turn on the corresponding scanning lines.

According to a preferred embodiment of the present disclosure, the sub-pixel array includes a plurality of first sub-pixels, a plurality of second sub-pixels, and a plurality of third sub-pixels; the first sub-pixels are red sub-pixels; the second sub-pixels are green sub-pixels; and the third sub-pixels are blue sub-pixels.

According to a preferred embodiment of the present disclosure, the GOA display panel comprises two of the first clock signal control terminals.

According to a preferred embodiment of the present disclosure, the first clock signal control terminals and the second clock signal control terminals successively and alternately enable the corresponding scanning lines.

According to a preferred embodiment of the present disclosure, the first clock signal control terminals and the second clock signal control terminals have an overlapped enabling time.

The present disclosure provides a GOA display panel and a GOA display apparatus which can be tested by displaying a pure color image of red, green, or blue on a screen to enhance defect detection rate of the GOA display panel and the GOA display apparatus, thereby lowering production cost of the GOA display panel and the GOA display apparatus.

BRIEF DESCRIPTION OF THE DRAWINGS

In order to explain the technical solutions in the present embodiments or in the prior art more clearly, accompanying drawings required in the description of the present embodiments or prior art will be briefly described. Obviously, accompanying drawings are just some embodiments of the present disclosure, while other drawings may be obtained by those skilled in the art according to these drawings, without paying out any creative work.

DETAILED DESCRIPTION OF THE PREFERRED EMBODIMENTS

Figure 1:
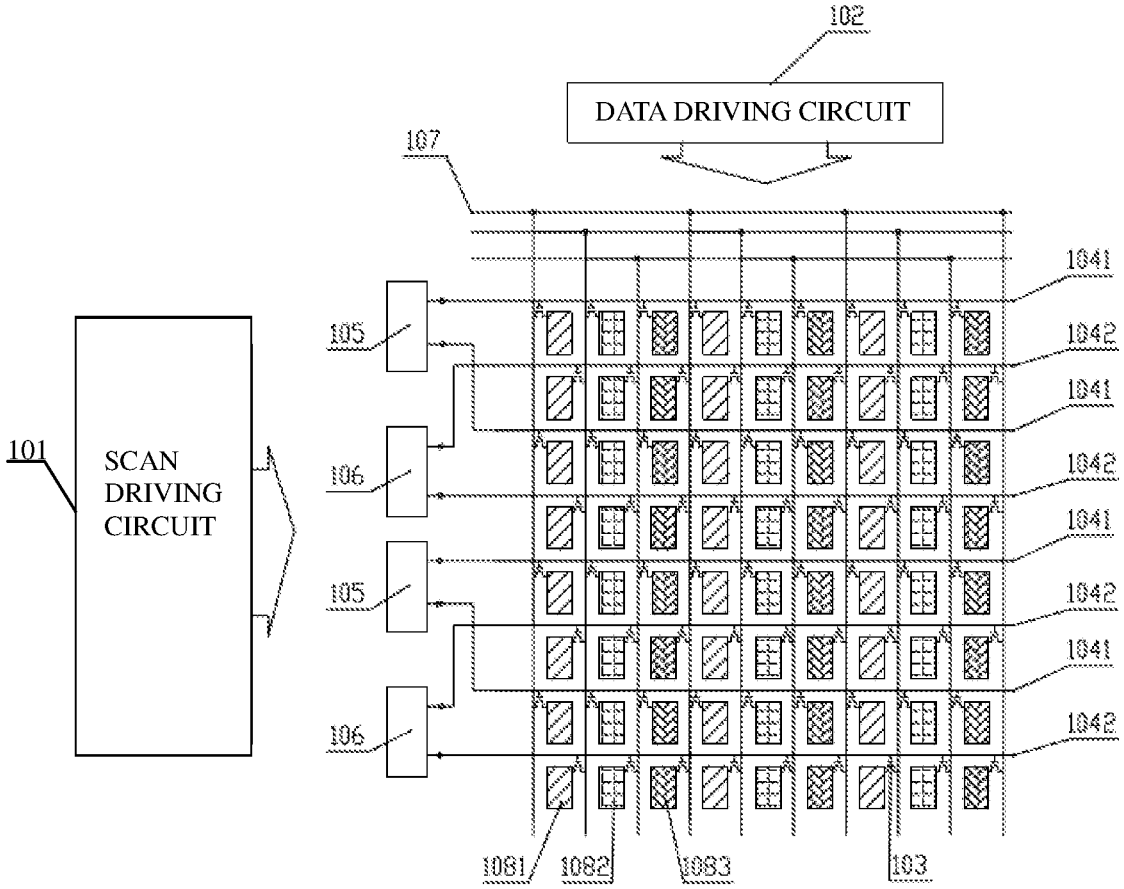
FIG. 1 is a partial structural view of a GOA display panel according to an embodiment of the present disclosure.

The foregoing objects, features and advantages adopted by the present disclosure can be best understood by referring to the following detailed description of the preferred embodiments and the accompanying drawings. Furthermore, the directional terms described in the present disclosure, such as upper, lower, front, rear, left, right, inner, outer, side, etc., are only directions referring to the accompanying drawings, so that the used directional terms are used to describe and understand the present disclosure, but the present disclosure is not limited thereto. In the drawings, similar structural units are designated by the same reference numerals.

The specific embodiments of the present disclosure are further described below in conjunction with the accompanying drawings.

For a technical problem existing in the conventional technology where when a GOA display panel goes through a display testing by using a module to light a screen through a printed circuit broad to display a pure colored image, an image with mixed-colors including red plus blue, red plus green, or blue plus green will be displayed instead, thereby being unable to accurately detect the defects of the screen, the present embodiment is able to solve the problem.

As shown in FIG. 1, the present disclosure provides a GOA display panel having a scan driving circuit 101, a data driving circuit 102, a thin-film transistor array 103, a plurality of scanning lines 104, a plurality of data lines 107, and a sub-pixel array 108. The sub-pixel array 108 includes at least two sub-pixels.

Each of the scanning lines 104 is connected to a row of sub-pixels, wherein starting from the first row of the sub-pixels, two of the scanning lines 1041 that are connected to two adjacent odd-numbered rows of the sub-pixels are both connected to a first clock signal control terminal 105; and two of the scanning lines 1042 that are connected to two adjacent even-numbered rows of the sub-pixels are both connected to a second clock signal control terminal 106.

The GOA display panel comprises a plurality of the first clock signal control terminals 105 and a plurality of the second clock signal control terminals 106 having the same number as the first clock signal control terminals 105. The adjacent first clock signal control terminals 105 and second clock signal control terminals 106 successively enable the corresponding scanning lines 104.

Preferably, the GOA display panel has two of the first clock signal control terminals 105.

Preferably, the first clock signal control terminals 105 and the second clock signal control terminals 106 have an overlapped enabling time.

Preferably, the sub-pixel array 108 includes a plurality of first sub-pixels, a plurality of second sub-pixels, and a plurality of third sub-pixels; wherein the first sub-pixels are red sub-pixels 1081, the second sub-pixels are green sub-pixels 1082, and the third sub-pixels are blue sub-pixels 1083.

Figure 2:
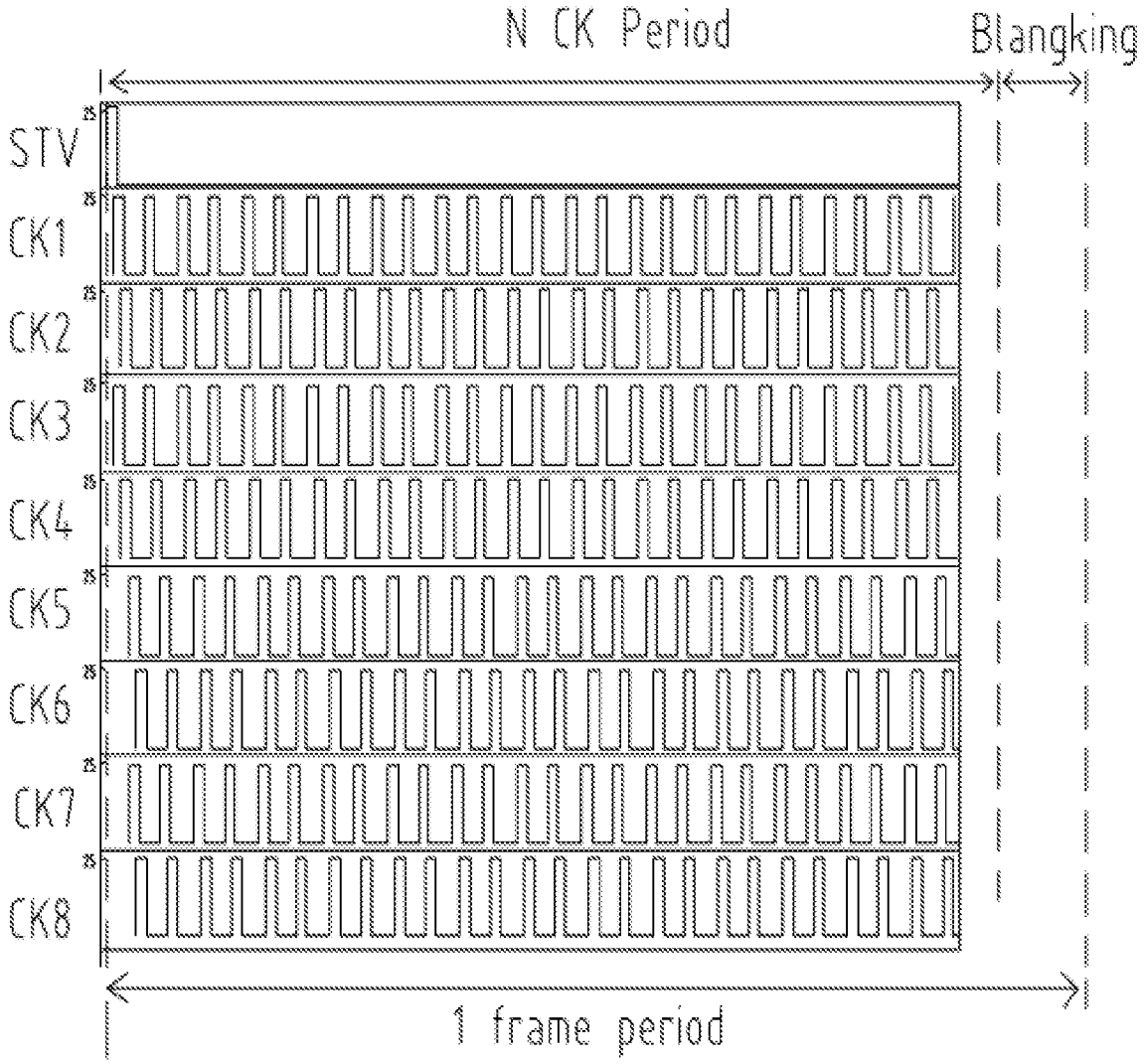
FIG. 2 is a schematic driving signal waveform of the GOA display panel according to an embodiment of the present disclosure.

FIG. 2 is a schematic driving signal waveform of the GOA display panel according to an embodiment of the present disclosure. By taking an 8CK (clock signal) GOA display panel as an example, starting from the first row of the sub-pixels, two of the scanning lines 1041 that are connected to two adjacent odd-numbered rows of the sub-pixels are both connected to the first clock signal control terminal 105, and two of the scanning lines 1042 that are connected to two adjacent even-numbered rows of the sub-pixels are both connected to the second clock signal control terminal 106. That is, CK1=CK3, CK2=CK4, CK5=CK7, CK6=CK8, wherein CK1 is a clock signal applied to the first scanning line; CK2 is a clock signal applied to the second scanning line; CK3 is a clock signal applied to the third scanning line, and so forth.

When detecting defects on a pure colored image screen of the GOA display panel, the data signals provided by the data driving circuit 102 can reduce to half of the frequency. That is, firstly the first one of the first clock signal control teiininals 105 is driven so that CK1 and CK3 are enabled together, wherein the blue sub-pixels 1083 are provided with a high level signal, and the red sub-pixels 1081 and the green sub-pixels 1082 are provided with a low level signal; then the first one of the second clock signal control ten iinals 106 is driven so that CK2 and CK4 are enabled together, wherein the red sub-pixels 1081 are provided with a high level signal, and the blue sub-pixels 1083 and the green sub-pixels 1082 are provided with a low level signal; and then the second one of the first clock signal control terminals 105 is driven so that CK5 and CK7 are enabled together, and so forth. Hence, a screen displaying a pure red image can be lit up using data signals having a frequency reduced by half to perform the defect detection. Based on the same theory, a screen displaying a pure green image or a pure blue image can also be lit up to perform the defect detection.

The present disclosure further provides a GOA apparatus including: a scan driving circuit, a data driving circuit, a thin-film transistor array, a plurality of scanning lines, a plurality of data lines, and a sub-pixel array. The sub-pixel array includes at least two sub-pixels.

Each of the scanning lines is connected to a row of sub-pixels; wherein starting from the first row of the sub-pixels, two of the scanning lines that are connected to two adjacent odd-numbered rows of the sub-pixels are both connected to a first clock signal control terminal; two of the scanning lines that are connected to two adjacent even-numbered rows of the sub-pixels are both connected to a second clock signal control terminal.

The GOA display panel further comprises a plurality of the first clock signal control terminals, and a plurality of the second clock signal control terminals having the same number as the first clock signal control terminals; the adjacent first clock signal control terminals and second clock signal control terminals successively turn on the corresponding scanning lines.

The working principle of the GOA display apparatus of the present preferred embodiment is identical to the working principle of the GOA display panel of the foregoing preferred embodiment, and therefore it can be specifically referred to the working principle of the GOA display panel of the foregoing preferred embodiment and will not described in detail again to avoid redundancy.

The present disclosure provides a GOA display panel and a GOA display apparatus which can be tested by displaying a pure color image of red, green, or blue on a screen to enhance defect detection rate of the GOA display panel and the GOA display apparatus, thereby lowering production cost of the GOA display panel and the GOA display apparatus.

In conclusion, although the present disclosure has been described with reference to the preferred embodiment thereof, it is apparent to those skilled in the art that a variety of modifications and changes may be made without departing from the scope of the present disclosure which is intended to be defined by the appended claims.

What is claimed is:

1. A gate driver on array (GOA) display panel, comprising:

a scan driving circuit, a data driving circuit, a thin-film transistor array, a plurality of scanning lines, a plurality of data lines, and a sub-pixel array, wherein the sub-pixel array includes a plurality of first sub-pixels, a plurality of second sub-pixels, and a plurality of third sub-pixels;

the first sub-pixels are red sub-pixels, the second sub-pixels are green sub-pixels, and the third sub-pixels are blue sub-pixels;

wherein each of the scanning lines is connected to a row of sub-pixels;

wherein starting from a first row of the sub-pixels, two of the scanning lines that are connected to two adjacent odd-numbered rows of the sub-pixels are both connected to a first clock signal control terminal;

two of the scanning lines that are connected to two adjacent even-numbered rows of the sub-pixels are both connected to a second clock signal control terminal;

wherein the GOA display panel further comprises a plurality of first clock signal control terminals and a plurality of second clock signal control terminals, and a number of the second clock signal control terminals is the same as a number of the first clock signal control terminals;

wherein adjacent first clock signal control terminal and second clock signal control terminals successively enable corresponding scanning lines, wherein the first clock signal control terminals and the second clock signal control terminals successively and alternately enable the corresponding scanning lines, the first clock signal control terminals and the second clock signal control terminals have an overlapped enabling time.

2. The GOA display panel as claimed in claim 1 comprises two of the first clock signal control terminals.

3. A GOA display panel, comprising:

a scan driving circuit, a data driving circuit, a thin-film transistor array, a plurality of scanning lines, a plurality of the data line, and sub-pixel array, the sub-pixel array includes at least two sub-pixels; wherein each of the scanning lines is connected to a row of sub-pixels;

wherein starting from the first row of the sub-pixels, two of the scanning lines that are connected to two adjacent odd-numbered row of the sub-pixels are both connected to a first clock signal control terminal;

two of the scanning lines that are connected to two adjacent even-numbered rows of the sub-pixels are both connected to a second clock signal control terminal;

wherein the GOA display panel further comprises a plurality of the first clock signal control terminals and a plurality of the second clock signal control terminals, and a number of the second clock signal control terminals is the same as a number of the first clock signal control terminals;

the adjacent first clock signal control terminals and second clock signal control terminals successively turn on the corresponding scanning lines, wherein the first clock signal control terminals and the second signal control terminals successively and alternately enable the corresponding scanning lines, and the first clock signal control terminals and the second clock control terminals have and overlapped enabling time.

4. The GOA display panel as claimed in claim 3, wherein the GOA display panel comprises two of the first clock signal control terminals.

5. A gate driver on array (GOA) display apparatus, comprising:

a scan driving circuit, a data driving circuit, a thin-film transistor array, a plurality of scanning lines, a plurality of data lines, and a sub-pixel array, the sub-pixel array includes at least two sub-pixels;

wherein each of the scanning lines is connected to a row of sub-pixels;

wherein starting from the first row of the sub-pixels, two of the scanning lines that are connected to two adjacent odd-numbered rows of the sub-pixels are both connected to a first clock signal control terminal;

two of the scanning lines that are connected to two adjacent even-numbered rows of the sub-pixels are both connected to a second clock signal control terminal;

wherein the GOA display panel further comprises a plurality of first clock signal control terminals and a plurality of second clock signal control terminals, and a number of the second clock signal control terminals is the same as a number of the first clock signal control terminals;

the adjacent first clock signal control terminals and second clock signal control terminals successively turn on the corresponding scanning lines, wherein the first clock signal control terminals and the second clock signal control terminals successively and alternately enable the corresponding scanning lines, and the first clock signal control terminals and the second clock signal control terminals have and overlapped enabling time.

6. The GOA display apparatus as claimed in claim 5, wherein the sub-pixel array includes a plurality of first sub-pixels, a plurality of second sub-pixels, and a plurality of third sub-pixels; the first sub-pixels are red sub-pixels; the second sub-pixels are green sub-pixels; and the third sub-pixels are blue sub-pixels.

7. The GOA display apparatus as claimed in claim 5, wherein the GOA display panel comprises two of the first clock signal control terminals.

* * * * *